United States Patent [19]

Just et al.

[11] Patent Number: 4,508,311

[45] Date of Patent: Apr. 2, 1985

[54] ANNULAR BLOWOUT PREVENTER

[75] Inventors: Friedrich E. Just; Bolie C. Williams, III, both of Houston, Tex.

[73] Assignee: Cameron Iron Works, Inc., Houston, Tex.

[21] Appl. No.: 441,056

[22] Filed: Nov. 12, 1982

[51] Int. Cl.[3] ..... E21B 33/06

[52] U.S. Cl. ..... 251/1 B; 251/1 A; 277/188 A; 277/235 A

[58] Field of Search ..... 251/1 A, 1 B, 1 R; 277/235 A, 188 A, 31

[56] References Cited

U.S. PATENT DOCUMENTS

| | | | |
|---|---|---|---|
| 2,843,349 | 7/1958 | Meyer | 251/1 B |
| 2,846,178 | 8/1958 | Minor | 251/1 B |
| 3,737,139 | 6/1973 | Watts | 251/1 B |
| 3,915,424 | 10/1975 | Le Rouax | 251/1 B |
| 4,310,139 | 1/1982 | Williams et al. | 251/1 B |

*Primary Examiner*—Martin P. Schwadron
*Assistant Examiner*—Sheri Novack
*Attorney, Agent, or Firm*—Vinson & Elkins

[57] ABSTRACT

An improved annular blowout preventer having a body with a central bore, an annular packer chamber facing the bore, an improved annular packer in said chamber and means for axially loading said annular packer to actuate it to closed position, said improved annular packer including a resilient annulus including an upper set of insert plates embedded in said annulus, a reaction ring embedded in the outer periphery of said annulus and means for moving said reaction ring toward said upper set of insert plates responsive to actuation of said packer loading means to ensure inward movement of said insert plates to their desired supporting position for said annulus when closed. The improved packer may have both upper and lower insert plates and upper and lower rings and a sleeve within the rings to ensure proper movement of both sets of insert plates.

4 Claims, 14 Drawing Figures

ANNULAR BLOWOUT PREVENTER

BACKGROUND

Annular blowout preventers have long been used on wells to provide a means for controlling blowouts. Metal inserts have been used on the upper and lower surfaces of the resilient packing annulus to provide support for such annulus as shown in U.S. Pat. No. 4,310,139. Such a preventer is actuated by axial loading of the resilient packing annulus. One problem encountered with such structure is that while one set of the support inserts moves into position to support the resilient annulus when the preventer is closed, the set of support inserts on the opposite side of the annulus may not always move fully into their preferred support position when actuated. Under these conditions the inner portion of the packer is not sufficiently confined to effect an acceptable seal.

Other devices have included projections on the plates embedded in the resilient packer annulus as an attempt to solve this problem to ensure that all of the insert plates move inward uniformly to provide the desired support allowing proper sealing of the packing annulus.

SUMMARY

The present invention relates to an improved annular blowout preventer having a body with a bore therethrough and having an annular shoulder thereon, an annular power chamber, an annular packing chamber opening to said bore, a piston in said power chamber and having an annular plate positioned in one end of said annular packing chamber, an annular packer positioned in said packing chamber between said annular plate and said shoulder, said annular packing including a resilient annulus with a plurality of essentially triangular upper insert plates and a plurality of essentially triangular lower insert plates embedded in the resilient annulus, a sleeve embedded in said annulus at a position spaced inward from the outer periphery of the annulus, an upper ring embedded in said resilient annulus in surrounding relation to said sleeve and slightly above the mid point of said resilient annulus, and a lower ring embedded in said annulus in surrounding relation to said sleeve and slightly below the mid point of said resilient annulus, and means coacting with the upper and lower rings to urge them apart as the resilient annulus is axially loaded.

An object of the present invention is to provide an improved annular blowout preventer with movable upper and lower inserts which move to their desired supporting position each time the preventer is actuated to closed position.

Another object is to provide an improved annular blowout preventer which ensures proper sealing each time the preventer is actuated to closed position.

A further object is to provide an improved annular blowout preventer having a resilient annulus in which flow of the annulus material is controlled during actuation to closed position to ensure inward movement of support inserts to their desired closed supporting position.

BRIEF DESCRIPTION OF THE DRAWINGS

These and other objects and advantages are hereinafter set forth and explained with reference to the drawings wherein.

DESCRIPTION OF THE PREFERRED EMBODIMENTS

Figure 1:
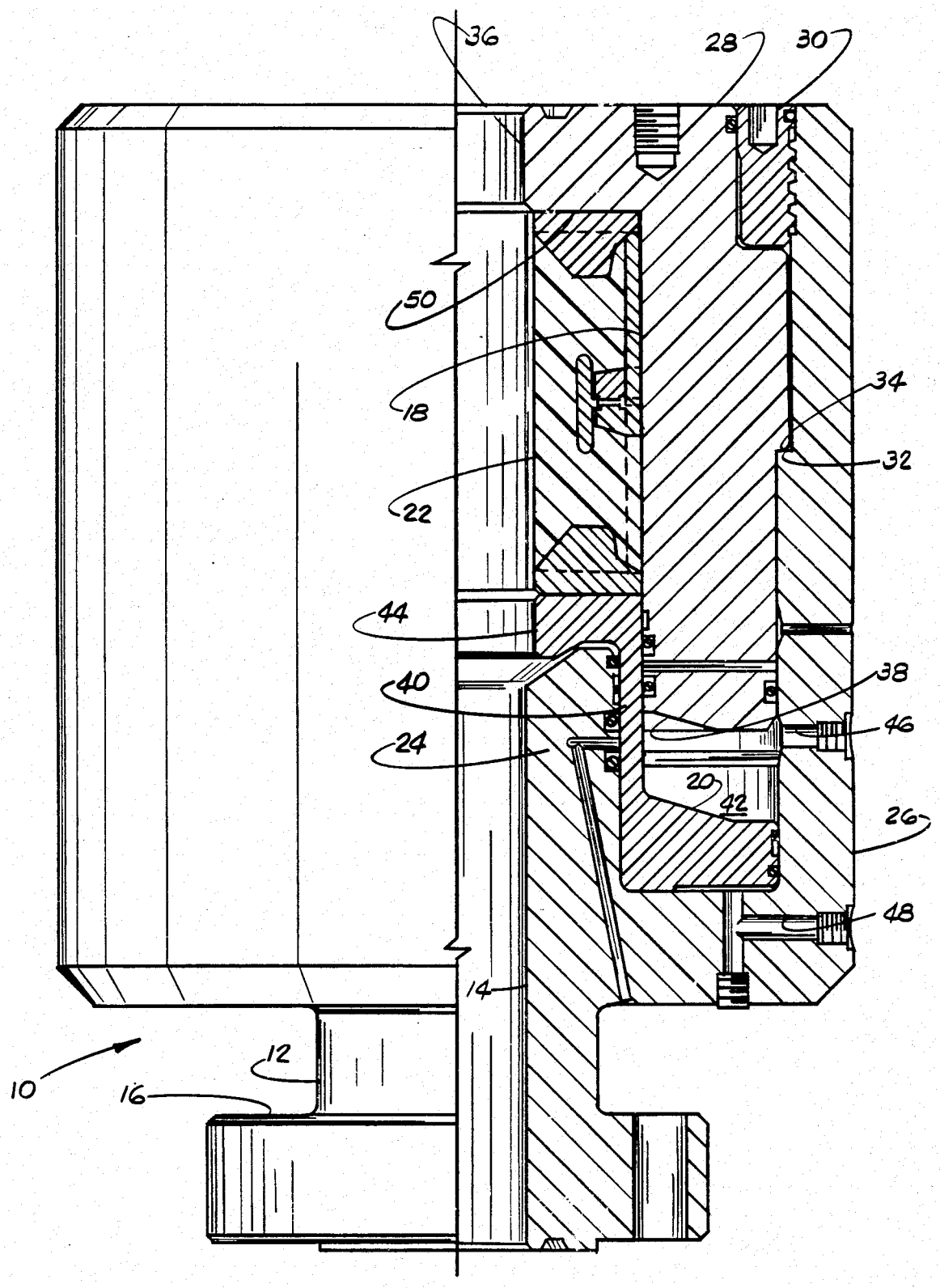
FIG. 1 is an elevation view of the improved annular blowout preventer of the present invention in open position and with one side shown in section.
Figure 2:
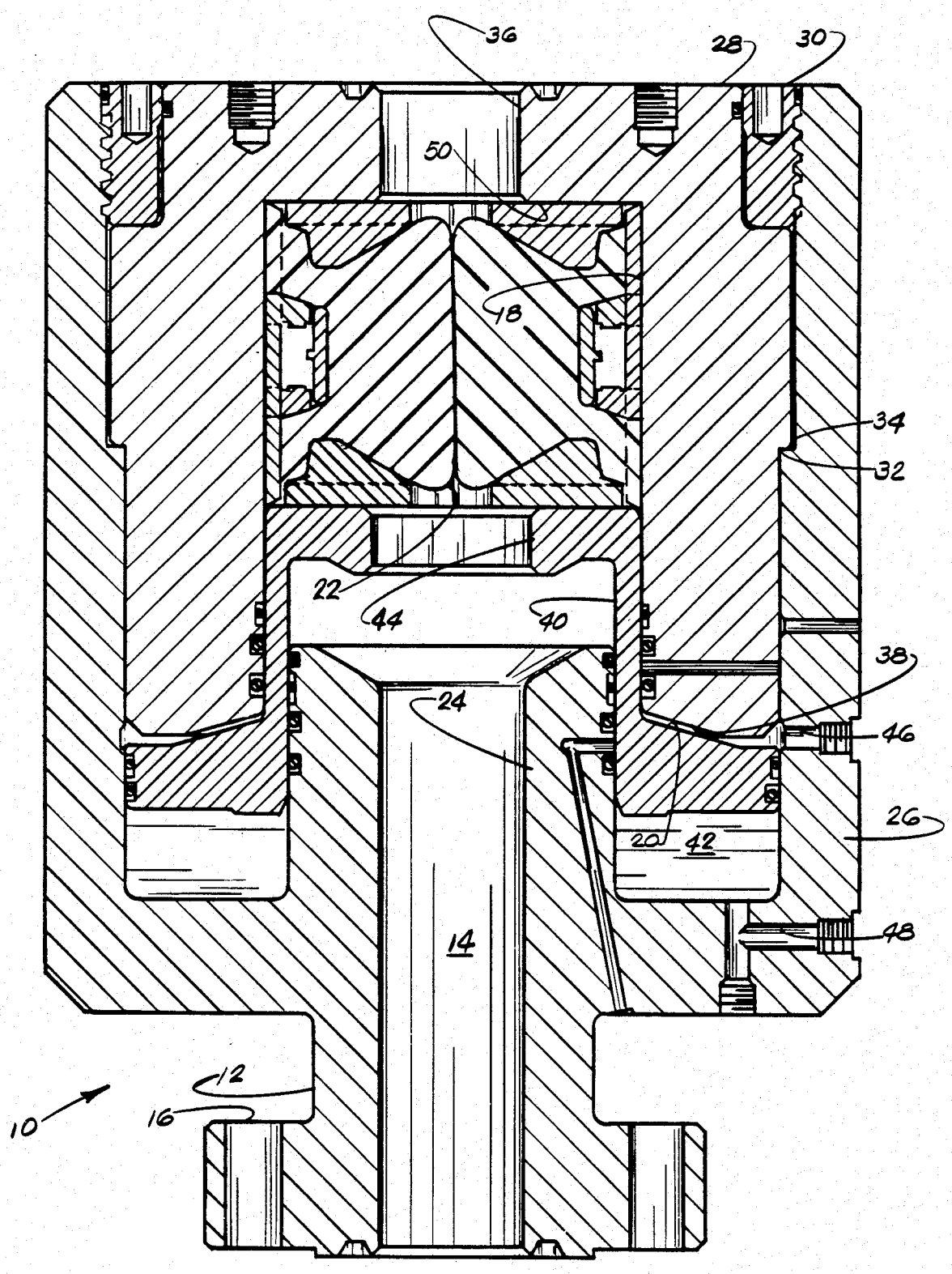
FIG. 2 is a similar view of the improved annular blowout preveter of the present invention in closed position.

As shown in FIGS. 1 and 2, annular blowout preventer 10 includes body 12 having central bore 14 extending therethrough with suitable connecting means such as flange 16 for connecting onto a stack (not shown). Annular packer recess 18 opens into bore 14 and actuating means, such as piston 20, is provided to actuate annular packer 22 in recess 18 as hereinafter described. Body 12 includes inner rim 24 and outer rim 26 with upper closure 28 locked within the upper end of rim 26 by locking ring 30.

Upper closure 28 includes downwardly facing shoulder 32 which engages shoulder 34 on the interior of outer rim 26, inner flange 36, and depending ring 38 which is sealed within rim 26 and spaced from the exterior of inner rim 24 a sufficient distance to allow piston arm 40 to slide therebetween. Power chamber 42 is below ring 38 between rims 24 and 26 and annular piston 20 is positioned therein for vertical movement. Arm 40 connects piston 20 to annular actuating plate 44. Ports 46 and 48 communicate with power chamber 42 above and below piston 20, as shown, to provide the pressure actuation of piston 20. The upward movement of piston 20 moves plate 44 upward to axially load annular packer 22 against shoulder 50 on the underside of flange 36.

Figure 3:
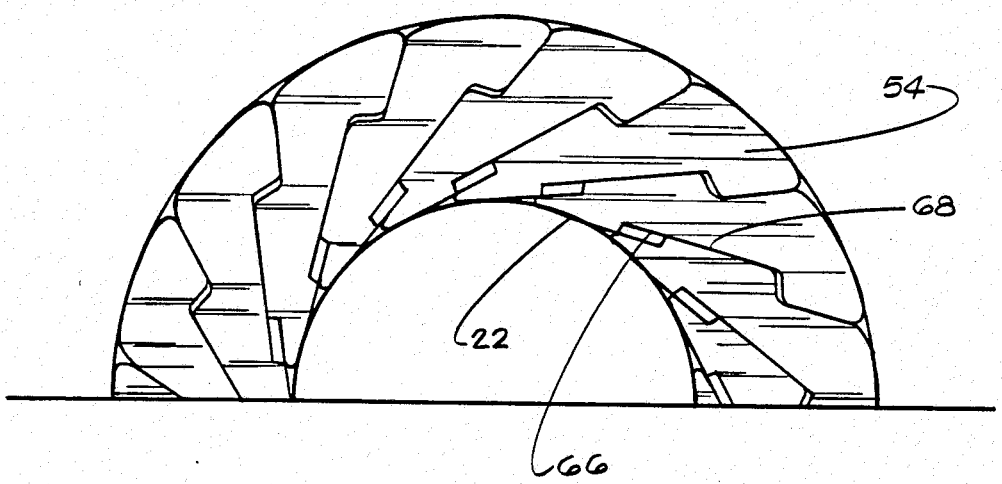
FIG. 3 is a partial plan view of the packer in open position.
Figure 4:
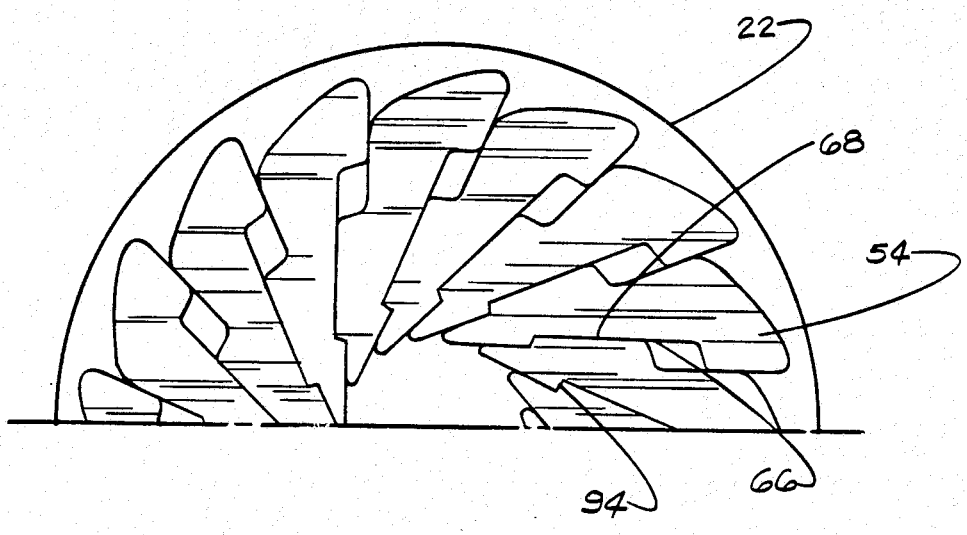
FIG. 4 is a partial plan view of the packer in closed position.

Annular packer 22 includes resilient annulus 52 with upper irising insert plates 54 and lower irising insert plates 56 embedded in the upper and lower surfaces of annulus 52. Each of upper insert plates 54 being triangular in shape as shown in FIGS. 3 and 4 and have projection 58 on their lower surface. Projection 58 tapers gradually downward from its inner end, is flat under the central portion of insert plate, extends vertically to provide shoulder 60 and tapers upwardly to the outer edge. Lower insert plates 56 are similar to plates 54 except that they are the mirror image of plates 54. In this way they will iris and move in the same direction as plates 54. They also include projections 62 with shoulders 64 and having substantially the same shape as projections 58 as shown. Each of plates 54 and 56 includes recess 66 along one side of the upper or lower portion of each of plates 54 and 56 respectively and projection 68 on the opposite sides of plates 54 and 56 which engages in the recess 66 of the adjacent plate.

Figure 5:
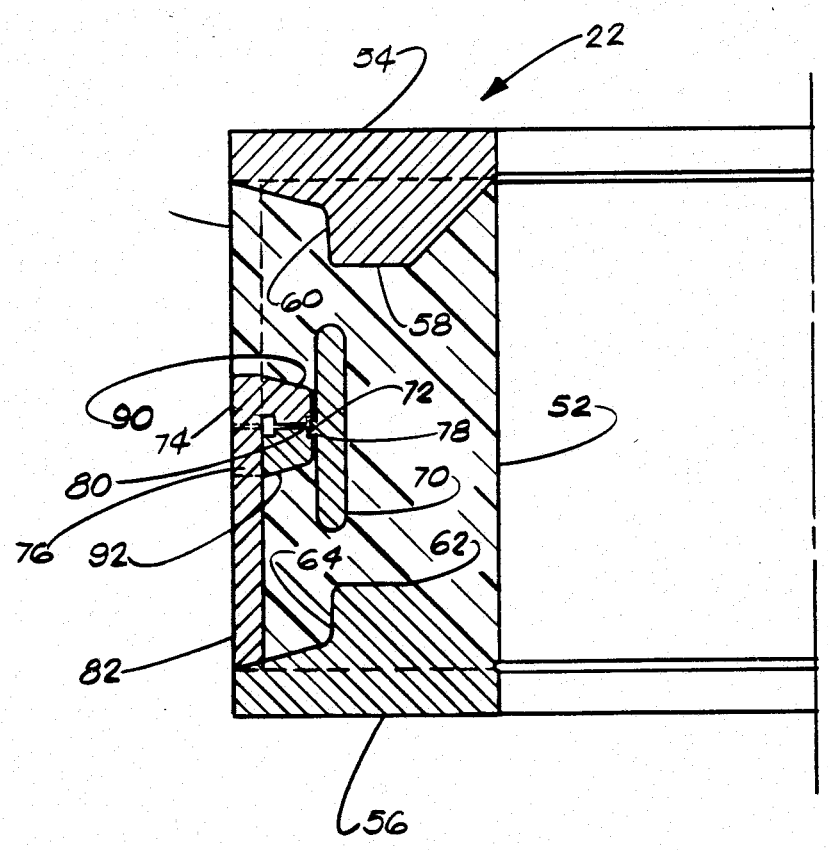
FIG. 5 is a detailed partial sectional view of the improved annular packer in open position.
Figure 7:
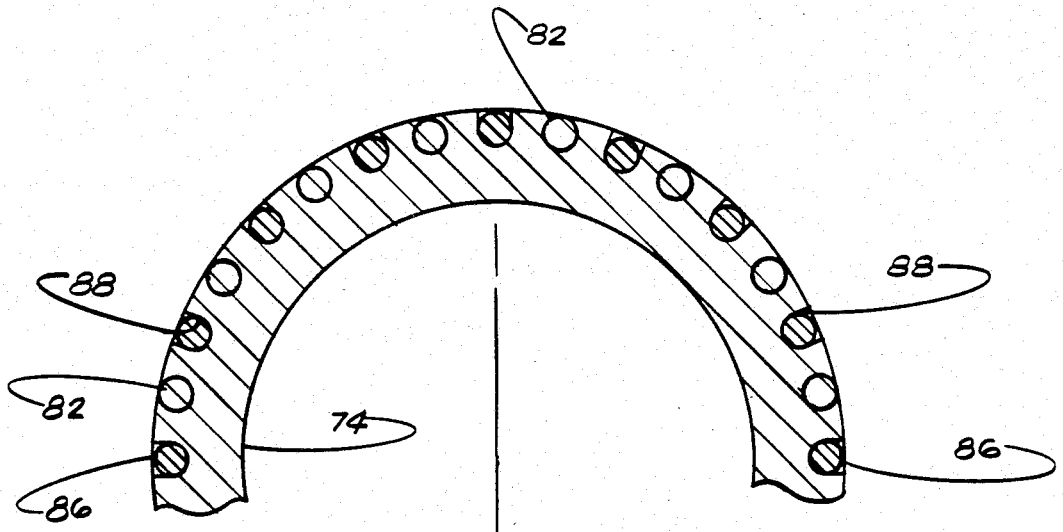
FIG. 7 is a partial sectional view of the annulus energizing means.
Figure 8:
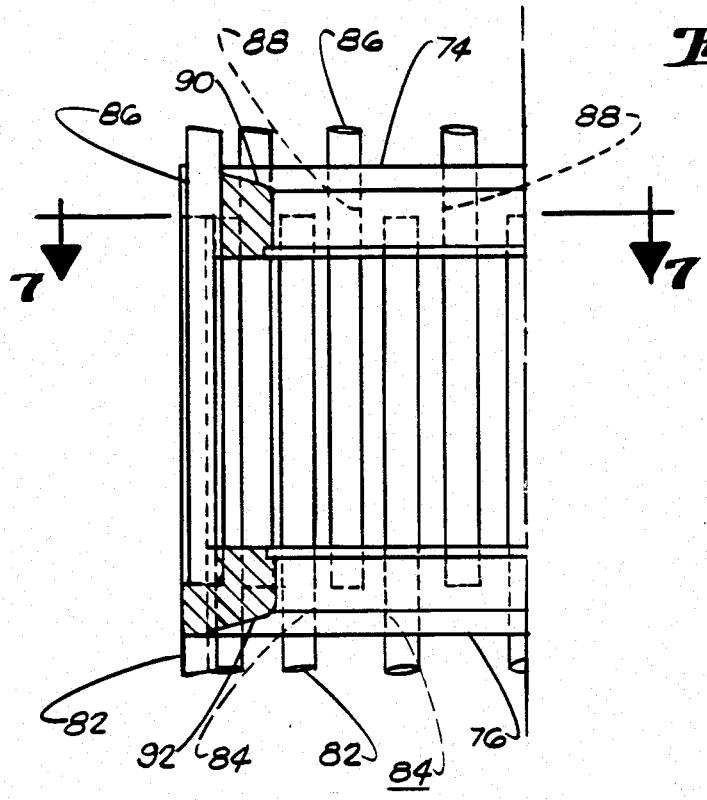
FIG. 8 is a vertical partial sectional view of the annulus energizing means.
Figure 9:
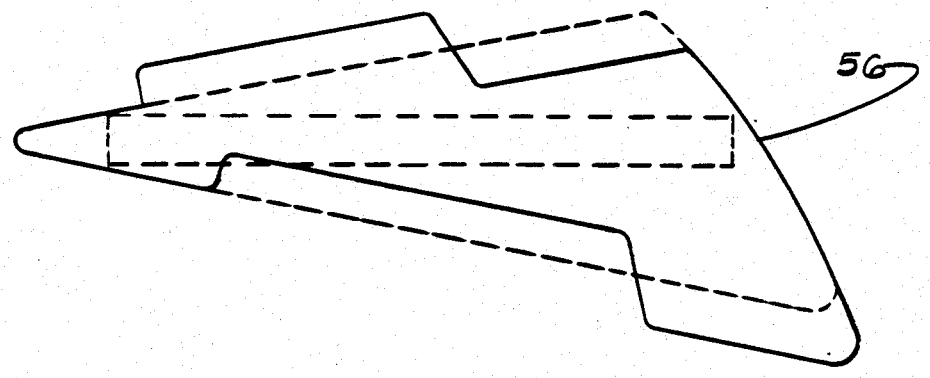
FIG. 9 is a plan view of one of the irising insert plates.
Figure 10:
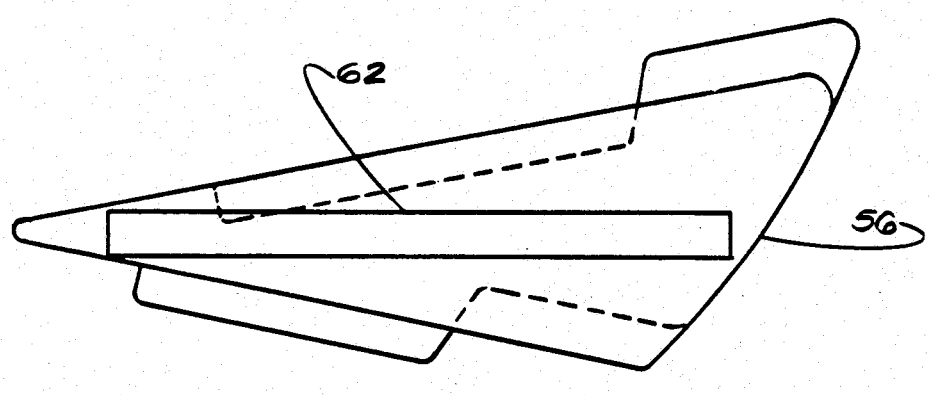
FIG. 10 is a bottom view of one of the insert plates.

Sleeve 70 is embedded in annulus 52 at a position equidistant from plates 54 and 56 and spaced inwardly from the outer periphery of annulus 52 and also spaced to have its outer surface approximately aligned with shoulders 60 and 64. Flange 72 extends from the mid point of the exterior surface of sleeve 70. Upper ring 74 and lower ring 76 are embedded in annulus 52 in surrounding relation to sleeve 70 with inner shoulder 78 on ring 74 and shoulder 80 on ring 76 engaging or close to flange 72 as shown in FIG. 5 when packer 22 is in its relaxed position. As best shown in FIGS. 7 and 8, pins 82 are secured to upper ring 74 extend through slots 84 in ring 76 and engage the outer portion of the top surface of insert plates 56 when packer 22 is in the open position of FIG. 5 and pins 86 are secured to lower ring 76 extend through slots 88 in ring 74 and engage the outer portion of lower surface of upper insert plates 54. Pins 82 and 86 extend through slots 84 and 88 in plates 76 and 74, respectively, to abut the upper surface of actuating plate 44 and shoulder 50.

Figure 6:
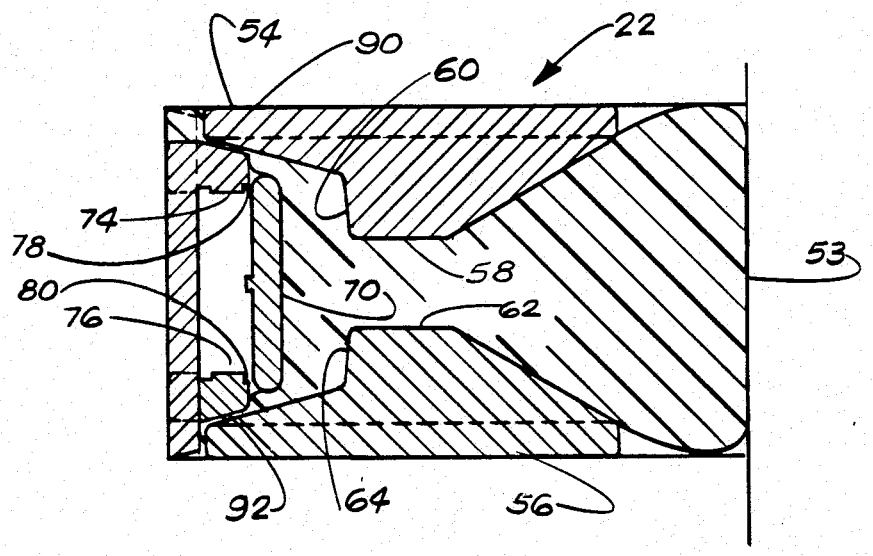
FIG. 6 is a detailed partial sectional view of the improved annular packer in closed position.

When packer 22 is to be closed, fluid pressure is supplied to port 48 and vented from port 46 to cause piston 20 to move upward to axially load packer 22. This axial loading of resilient annulus 52 causes it to be deformed inwardly to the position shown in FIG. 2. This compression movement moves insert plates 54 and 56 inward in an irising movement which brings them to the supporting position shown in FIGS. 2 and 6. The coactions of rings 74 and 76, pins 82 and 86, sleeve 70 and insert plates 54 and 56 provide the means to ensure that annular packer 22 when actuated to close moves into closed sealing engagement with proper support from both upper and lower insert plates 54 and 56.

As plate 44 is moved upward resilient annulus 52 is loaded axially and is deformed into the smaller vertical dimension, and since the material of such packer when deformed in one direction moves in another direction so that it occupies substantially the same volume, resilient annulus 52 moves inward to closed position. At the same time this actuation movement causes upper ring 74 to move upward toward upper insert plates 54 and causes lower ring 76 to move downward toward lower insert plate 56. Ring 74 has an upper surface 90 which tapers downward and inward and engages resilient annulus 52 to move its upper peripheral portion upward and inward. Such movement is directed against insert plates 54 and in particular against shoulder 60 to ensure full desired inward movement of such plates 54. Ring 76 has a lower surface 92 which tapers upward and inward and engages resilient annulus 52 to move its lower outer peripheral portion downward and inward. Such movement is directed against insert plates 56 and in particular against shoulder 64 to ensure full desired inward movement of such plates 56. Pins 82 and 86 maintain rings 74 and 76 substantially equidistant from the axial extremes of packer 22 and therefore provide substantially the same movement but in opposite directions of rings 74 and 76.

When insert plates 54 and 56 have reached their desired innermost position projections 68 which engage in the adjacent recess 66 engage shoulder 94 at the inner end of recess 66 and this together with the wedging engagement of the insert plates, forms a substantially solid support plate above and below resilient annulus 52 so that it has adequate support for sealing when closed.

Figure 11:
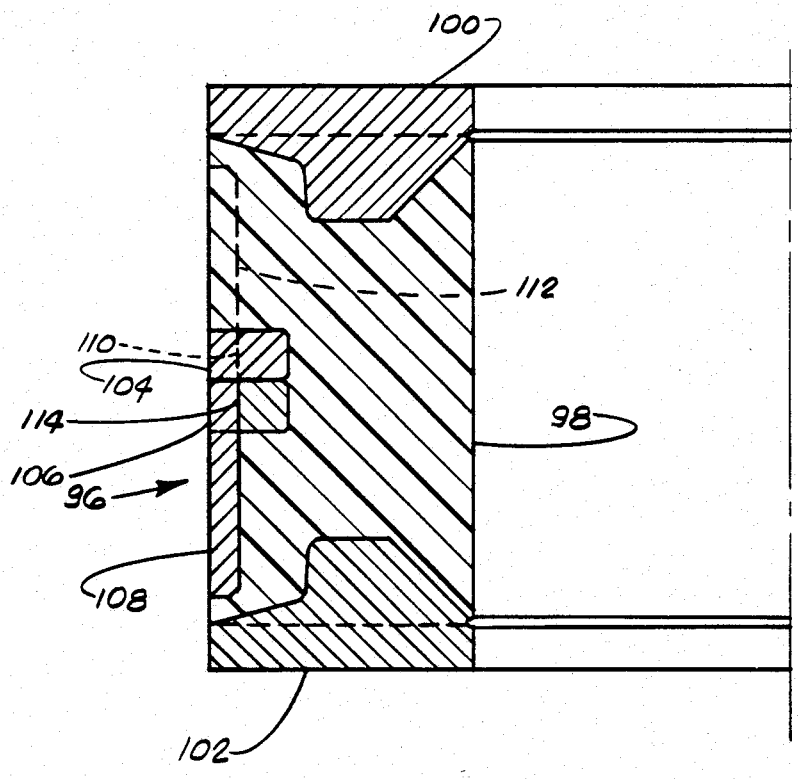
FIG. 11 is a detailed partial sectional view of a modified form of improved annular packer in open position.
Figure 12:
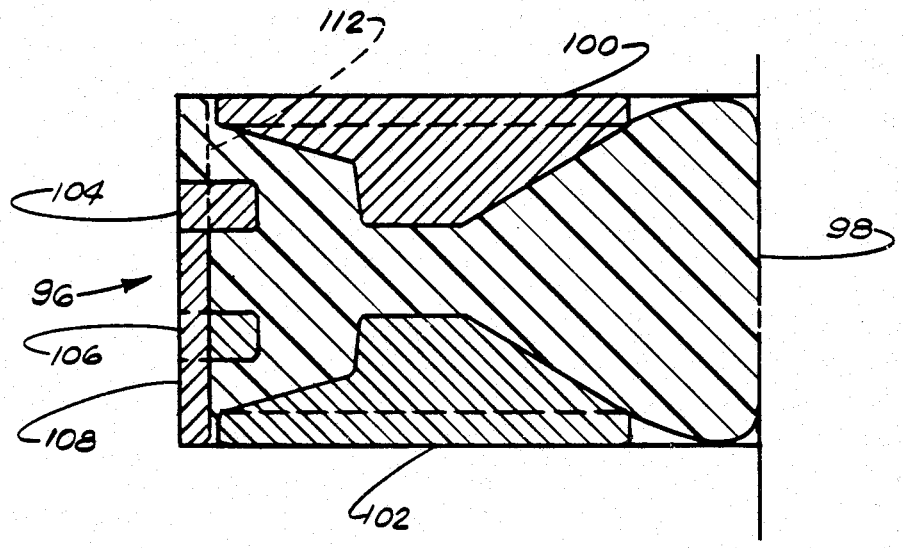
FIG. 12 is a detailed partial sectional view of the packer shown in FIG. 11 in closed position.
Figure 13:
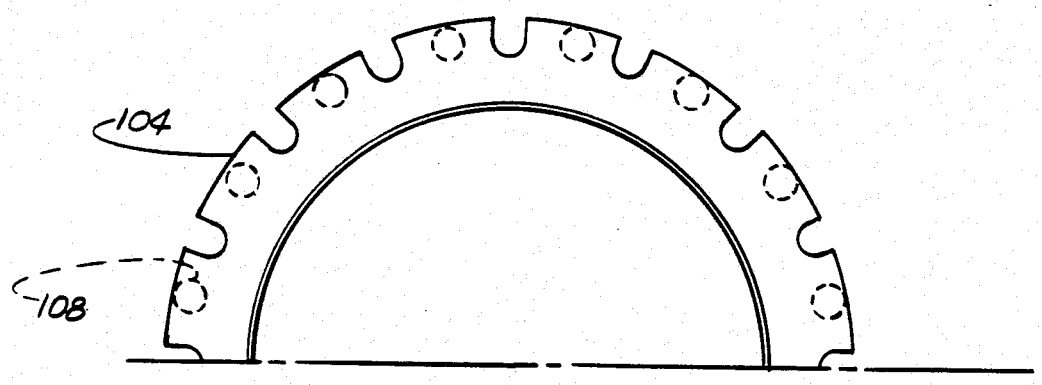
FIG. 13 is a partial plan view of one of the energizing rings and pins of the energizing means.
Figure 14:
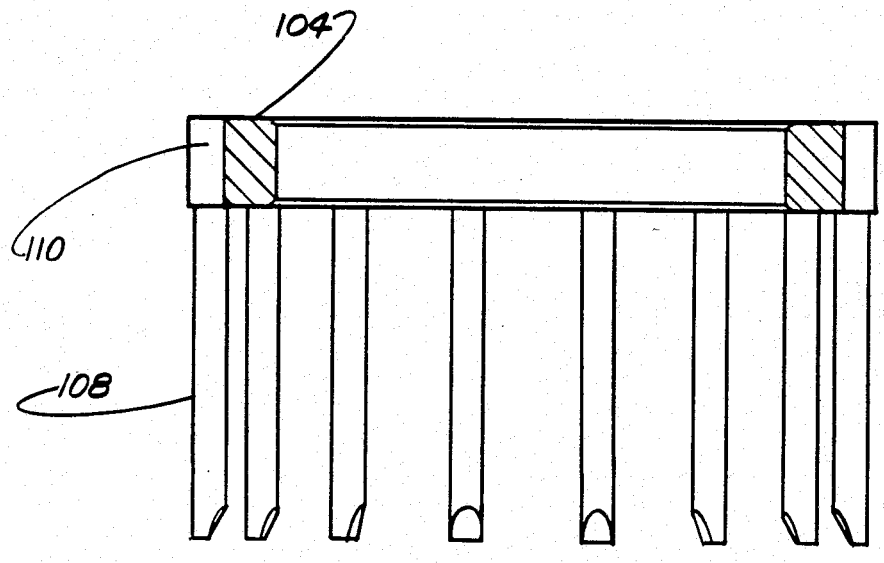
FIG. 14 is a sectional view of the energizing ring taken along line 14—14 in FIG. 13.

The modified packer 96 shown in FIGS. 11 and 12 includes resilient annulus 98 with upper insert plates 100 and lower insert plates 102 embedded therein. Also upper ring 104 and lower ring 106 are embedded in the mid portion of annulus 98. Upper ring 104 has a plurality of pins 108 extending downward therefrom as shown in FIG. 14 with slots 110 extending through ring 104 to allow pins 112 which are secured to lower ring 106 to extend upwardly therefrom through slots 110. Lower ring 106 also has slots 114 through which pins 108 extend.

As shown in FIG. 11, the lower end of pins 108 are spaced above the upper surface of lower insert plates 102 and the upper end of pins 112 are spaced below the lower surface of upper insert plates 100 with packer 96 in its relaxed position. As packer 96 is loaded axially pins 108 engage the upper surface of annular actuating plate (not shown) and pins 112 engage the shoulder (not shown) above packer 96 to cause rings 104 and 106 to move apart and thus force portions of resilient annulus 98 inward to ensure the desired inward movement of insert plates 100 and 102. Thus, packer 96 is substantially similar to packer 22 except that it does not include a sleeve such as sleeve 70 in packer 22 and the ring pins in the relaxed position are spaced from the insert plates.

What is claimed is:

1. An annular blowout preventer comprising a body having a central bore therethrough with an annular packer recess surrounding and opening onto said bore an annular packer positioned in said packer recess, and means for axially loading said annular packer, said annular packer including a resilient annulus, a plurality of insert plates embedded in the upper surface of said annulus, a plurality of insert plates embedded in the lower surface of said annulus, a sleeve embedded in said annulus at a position spaced inward from the outer periphery thereof and having its upper end spaced from the underside of said upper insert plates and its lower end spaced substantially the same distance above the upper surface of the lower insert plates, a first ring embedded in said annulus surrounding said sleeve at a position above its mid point, a second ring embedded in said annulus surrounding said sleeve at a position below its mid point, means coacting with said upper ring to move it upward with respect to said sleeve as said packer is compressed, and means coacting with said lower ring to move it downward with respect to said sleeve as said packer is compressed.

2. An annular blowout preventer according to claim 1 wherein said means coacting with said upper ring includes a plurality of pins extending in sliding relationship through said lower ring to said insert plates on the lower surface of said annulus, and said means coacting with said lower ring includes a plurality of pins extending in sliding relationship through said upper ring to said insert plates on the upper surface of said annulus.

3. An annular packer for use in an annular blowout preventer comprising a resilient annulus, a plurality of insert plates embedded in the upper surface of said annulus, a plurality of insert plates embedded in the lower surface of said annulus, a sleeve embedded in said annulus at a position spaced inward from the outer periphery thereof and having its upper end spaced from the underside of said upper insert plates and its lower end spaced substantially the same distance above the upper surface of the lower insert plates, a first ring embedded in said annulus surrounding said sleeve at a position above its mid point, a second ring embedded in said annulus surrounding said sleeve at a position below its mid point, means coacting with said upper ring to move it upward with respect to said sleeve as said packer is compressed, and means coacting with said lower ring to move it downward with respect to said sleeve as said packer is compressed.

4. An annular packer according to claim 3 wherein said means coacting with said upper ring includes a plurality of pins extending in sliding relationship through said lower ring to said insert plates on the lower surface of said annulus, and said means coacting with said lower ring includes a plurality of pins extending in sliding relationship through said upper ring to said insert plates on the upper surface of said annulus.

* * * * *